US005667433A

United States Patent [19]

Mallon

[11] Patent Number: 5,667,433

[45] Date of Patent: Sep. 16, 1997

[54] KEYED END EFFECTOR FOR CMP PAD CONDITIONER

[75] Inventor: Thomas G. Mallon, Santa Clara, Calif.

[73] Assignee: LSI Logic Corporation, Milpitas, Calif.

[21] Appl. No.: 481,799

[22] Filed: Jun. 7, 1995

[51] Int. Cl.[6] ..... B24B 5/00

[52] U.S. Cl. ..... 451/287; 451/443; 451/56; 451/494; 451/508

[58] Field of Search ..... 451/443, 444, 451/56, 41, 285, 287, 553, 548, 550, 494, 508, 521

[56] References Cited

U.S. PATENT DOCUMENTS

| | | | |
|---|---|---|---|
| 1,380,370 | 6/1921 | Fjellman | 451/287 |
| 2,099,179 | 11/1937 | Stainbrook | 451/285 |
| 2,541,912 | 2/1951 | Broughton | 451/56 |
| 2,662,519 | 12/1953 | Metzger | 451/443 |
| 3,623,276 | 11/1971 | Twigg | 451/550 |
| 5,472,371 | 12/1995 | Yamakura et al. | 451/56 |
| 5,486,131 | 1/1996 | Cesna et al. | 451/56 |

*Primary Examiner*—James G. Smith
*Assistant Examiner*—Dona C. Edwards
*Attorney, Agent, or Firm*—Luedeka, Neely & Graham, P.C.

[57] ABSTRACT

A polishing pad conditioner has a grid with an abrasive surface for conditioning a polishing pad. Opposite the abrasive side of the grid, there is a back surface, having at least one key way, which extends at least partially into the back surface. A grid holder has a number of keys equal to the number of key ways in the back surface of the grid. The grid holder keys engage the grid key ways, thereby eliminating slippage between the grid and the grid holder. A mechanized arm is attached to the grid holder, and imparts a rotational and translational motion to the grid holder. A magnet may be used as an attachment means between the grid and the grid holder. The key ways of the grid and the keys of the grid holder may be arranged such that the grid holder can only receive the grid with the back surface of the grid facing the grid holder.

11 Claims, 2 Drawing Sheets

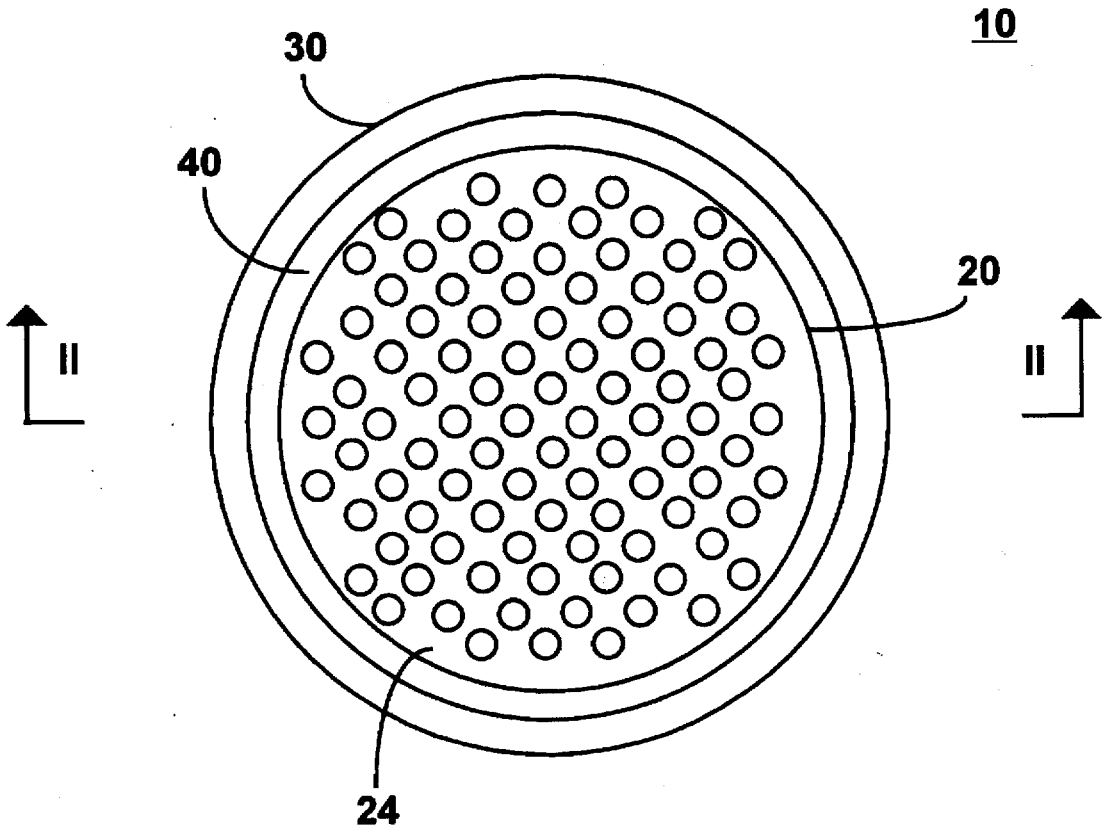
Fig.1 - Prior Art
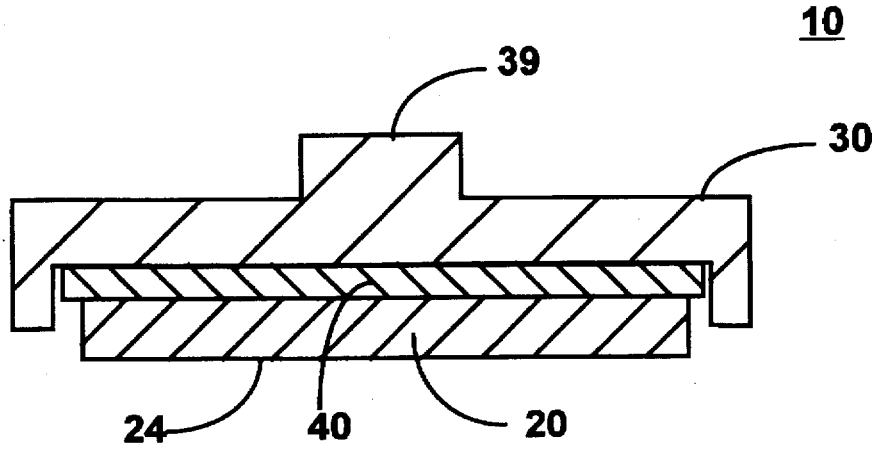
Fig. 2 - Prior Art

KEYED END EFFECTOR FOR CMP PAD CONDITIONER

FIELD OF THE INVENTION

The present invention relates to the polishing of wafers, and more particularly to the chemical-mechanical polishing of semiconductor devices.

BACKGROUND OF THE INVENTION

Chemical-mechanical polishing (CMP) is used to planarize a semiconductor device. Planarizing the devices reduces problems such as step coverage during subsequent processing. Typically, CMP is performed after the devices are partially formed in the semiconductor material, but before the wafer is diced and the devices are separated one from another.

During CMP, a polishing pad is brought into contact with the front surface of the wafer, where the devices are formed. A polishing slurry is applied between the polishing pad and the wafer, and the wafer and pad are moved relative to each other. The slurry acts upon the wafer to both chemically etch and mechanically wear the devices. The movement between the wafer and pad helps provide a uniform removal of material at the surface of the devices.

As the erosion occurs, the material removed from the wafer tends to clog and mat the surface of the polishing pad, reducing its abrasive action, and causing a reduction in the rate of material removal. Great care must be taken during CMP to ensure that the devices are thinned to within a predetermined range, or they will not function properly.

To ensure uniformity and consistency of device thinning throughout the CMP process, the polishing pad is conditioned by running a rough implement across it. Conditioning is done either intermittently during CMP, or continuously, with the polishing pad rotating across the rough implement in one area, and then across the wafer in another. The rough implement removes the debris that is clogging the polishing pad, and restores the surface of the polishing pad, thus enhancing control of the CMP process. A motion, such as rotation and translation, is imparted to the rough implement so that the polishing pad is uniformly conditioned. The rough implement and the assembly used to hold it are collectively referred to as a conditioner.

A conditioner 10 according to the prior art is depicted in FIG. 1. A grid 20 is used as the rough implement to condition the polishing pad. A grid holder 30 holds the grid 20 in place, and a magnet 40 secures the grid 20 to the grid holder 30. Referring now to FIG. 2, there is shown a mounting bracket 39, which is attached to the grid holder 30. A mechanized arm (not depicted) attaches to the mounting bracket 39, and imparts a rotational movement to the grid holder 30. The rotational movement is conducted through the magnet 40 to the grid 20. The surface 24 of the grid 20 is an abrasive surface, which conditions the polishing pad as the grid 20 rotates across the pad.

It has been discovered that the magnet 40 is unable to hold the grid 20 securely, and slippage occurs at the magnet 40 interfaces between the grid holder 30 and the grid 20. This slippage allows the grid 20 to slow or stop occasionally, reducing the uniformity of the pad conditioning process. Additionally, the slippage between the magnet 40 interfaces erodes material at the interfaces. This material falls onto the polishing pad, and into the polishing slurry, acting as a source of contamination which reduces the controllability of the CMP process, and introduces impurities into the semiconductor devices.

Additionally, the grid 20 can be placed improperly within the grid holder 30, such that the abrasive surface 24 is adjacent the magnet 40. When this occurs, the polishing pad will not be adequately conditioned, and the CMP of the wafer will not be optimized. Further, the abrasive surface 24 will tend to create even more eroded material as slippage occurs between the grid 20 and the magnet 40.

What is needed, therefore, is a method and apparatus of reliably and securely engaging the rough implement used to condition the polishing pad to the apparatus that controls its movement. It is an object of this invention to provide such an apparatus and method.

SUMMARY OF THE INVENTION

According to the present invention there is provided a conditioner for conditioning a polishing pad used for polishing a semiconductor wafer. The conditioner includes an abrasive conditioning implement, with an abrasive front surface which rotates in a rotation plane, for being applied to condition the polishing pad. The abrasive conditioning implement has a back surface disposed in a spaced apart, oppositely facing relationship with the abrasive front surface.

An abrasive conditioning implement holder system receives and holds the abrasive conditioning implement, with the back surface of the abrasive conditioning implement oriented toward the abrasive conditioning implement holder system, and the front surface is exposed for conditioning the polishing pad. The abrasive conditioning implement holder system rotates the abrasive conditioning implement in the rotation plane so that the front surface remains in the rotation plane during the rotation.

An interlock system locks the abrasive conditioning implement to the abrasive conditioning implement holder system to prevent relative rotation between the abrasive conditioning implement and the abrasive conditioning implement holder system while the abrasive conditioning implement is being rotated.

In a preferred embodiment the interlock system is a key formed in one of the abrasive conditioning implement holder system, and a key way formed in the abrasive conditioning implement. The key way is configured to matingly receive the key when the abrasive conditioning implement is being held by the abrasive conditioning implement holder system. In other embodiments, one may reverse the positions of the key and the key way.

In a most preferred embodiment, the keys form an asymmetric pattern, and the key ways also form an asymmetric pattern. The asymmetric patterns allow the abrasive conditioning implement to be held in the abrasive conditioning implement holder system with the back surface oriented toward the abrasive conditioning implement holder system, and prevent the abrasive conditioning implement from being received by the abrasive conditioning implement holder system with the front face oriented toward the abrasive conditioning implement holder system.

The abrasive conditioning implement holder system may also have a holder for holding the abrasive conditioning implement, and a magnet disposed between the holder and the abrasive conditioning implement, to magnetically hold the abrasive conditioning implement. In this embodiment, a key way is formed in the magnet, configured to matingly receive the key.

BRIEF DESCRIPTION OF THE DRAWINGS

The present invention may best be understood by reference to a detailed description of preferred embodiments when considered in conjunction with the following drawings, in which:

FIG. 1 is a bottom view of a conditioner according to the prior art;

FIG. 2 is a cross-sectional view of a conditioner according to the prior art;

DETAILED DESCRIPTION OF PREFERRED EMBODIMENTS

Figure 3:
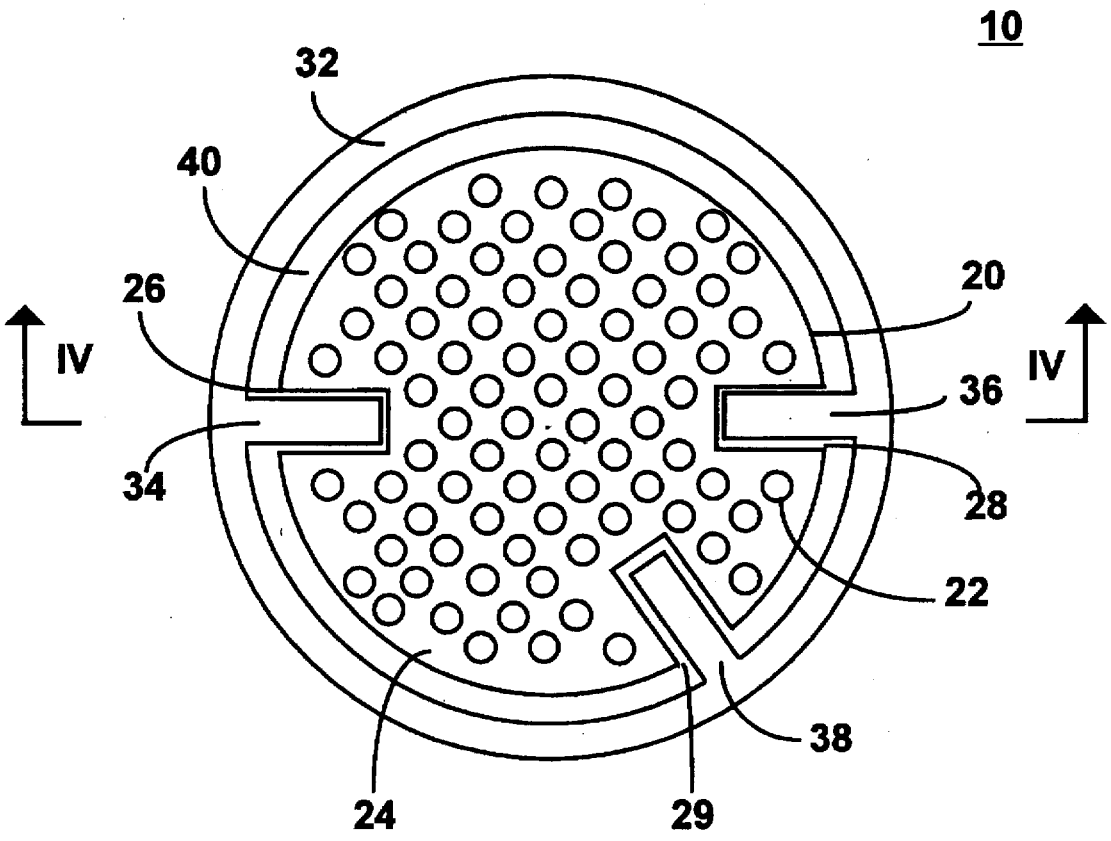
FIG. 3 is a bottom view of a conditioner according to the present invention.

Referring now to the drawings in which like reference characters designate like or corresponding parts throughout the several views, there is shown in FIG. 3 a conditioner 10 according to a preferred embodiment of the present invention, as viewed from the bottom. The conditioner 10 is generally circular in shape, and is comprised of three different elements, an abrasive conditioning implement, such as a grid 20, an abrasive conditioning implement holder system, such as a grid holder 30, and an attachment means or holder system, such as a magnet 40.

The grid 20 is generally circular in shape, and may be fashioned of any durable material, such as metal or ceramic. In a preferred embodiment, the grid 20 is fashioned of a magnetic material, such as steel. In the front surface 24 of the grid 20 there are formed a plurality of holes 22, which extend through the grid 20 from the front surface 24, to the back surface, which is not depicted in this view. In alternate embodiments, the holes 22 do not extend entirely through the grid 20, but are dimples in the front surface 24 of the grid 20. The holes 22 provide a void in which material that is removed from the polishing pad during conditioning can collect, and also provide additional edges which further enhance pad conditioning.

Also formed in the grid 20 is at least one key way 26. In the preferred embodiment there is more than one key way, such as additional key ways 28 and 29 as shown. The depiction of the key ways 26, 28, and 29 are exaggerated in size in FIGS. 3 and 4, so that they can be better visualized and understood. The key ways 26, 28, and 29 are formed in the back surface of the grid 20, and extend at least partially into the back surface. In the embodiment depicted in FIG. 3, the key ways 26, 28, and 29 extend completely through the grid 20, from the back surface to the front surface 24. Also in the preferred embodiment, the front surface 24 of the grid 20 has applied to it an abrasive coating, such as diamond grit in a binder such as nickel, making the front surface 24 an abrasive surface.

The grid 20 fits inside of a grid holder 30, which has a rim 32 which extends around the perimeter of the grid 20. Extending radially inward from the rim 32 of the grid holder 30 is at least one key 34. The number of keys on the grid holder 30 is equal to the number of key ways in the grid 20. In the embodiment depicted in FIG. 3, there are three keys 34, 36, and 38, which, like the key ways 26, 28, and 29, are exaggerated in size as depicted. The keys 34, 36, and 38 fit into and engage key ways 26, 28, and 29 respectively.

Figure 4:
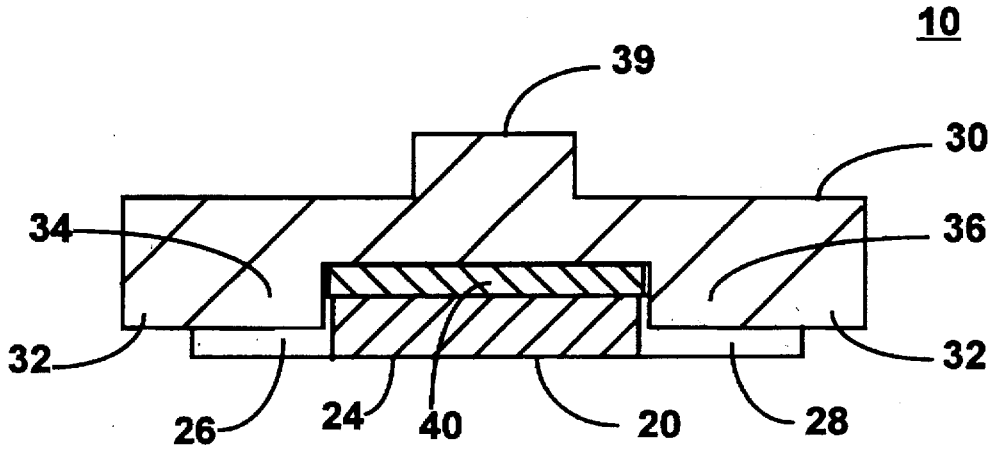
FIG. 4 is a cross-sectional view of a conditioner according to the present invention.

As depicted in FIGS. 3 and 4, there is a tolerance gap between the keys 34, 36, and 38, and the edges of the key ways 26, 28, and 29. While there needs to be some amount of tolerance between these features in the preferred embodiment, they are depicted with an exaggerated amount of tolerance so as to make them easier to see, and FIGS. 3 and 4 easier to understand.

The engagement of key ways 26, 28, and 29 with keys 34, 36, and 38 prevents the grid 20 from slipping with respect to the grid holder 30 when the grid holder 30 moves. Additionally, the key ways and keys may be arranged such that the grid holder 30 may only receive the grid 20 with the back surface of the grid 20 facing the grid holder 30. In this manner the grid 20 cannot be positioned in the grid holder 30 with the back surface of the grid 20 exposed to the polishing pad. Such a situation is to be avoided because the back surface of the grid 20 is not abrasive like the front surface 24, and therefore cannot condition the polishing pad as effectively as the front surface 24.

In the embodiment depicted in FIG. 3, the key ways 26, 28, and 29 are all the same shape and size, and are placed asymmetrically around the perimeter of the grid 20 in a manner such that the grid 20 can only fit into the grid holder 30 in a single orientation. In alternate embodiments the key way and key formations may accomplish the same goal by providing key ways and keys of different lengths, widths, or shapes. For example, a single L-shaped key way, and matching key at the perimeter of the grid 20, would provide the desired benefits of preventing the grid 20 from slipping as the grid holder 30 rotates, and would allow the grid 20 to be fitted to the grid holder 30 in only a single orientation.

In yet another embodiment, the key ways are not placed about the peripheral of the grid 20, but are placed in from the edge of the grid 20. In this embodiment the keys do not extend radially inwardly from the rim 32 of the grid holder 30, but instead extend axially outwardly from that surface of the grid holder 30 which is proximate to, and coplanar with the back surface of the grid 20. The keys and key ways of this embodiment could be of any shape, such as round, square, or triangular. The ability to restrict insertion of the grid 20 into the grid holder 30 in a single orientation could be provided by an asymmetrical arrangement of the key ways and keys, or by making the key ways and keys of varying shapes or sizes.

Also depicted in FIG. 3 is magnet 40, which is placed into the grid holder 30 prior to the insertion of the grid 20, and which retains the grid 20 in proximity to the grid holder 30 so that the grid 20 cannot fall out of the grid holder 30 should the conditioner 10 raise off the surface of the polishing pad being conditioned. Magnet 40 preferably has key ways corresponding to those found in the grid 20, which extend completely through the magnet 40. In an alternate embodiment, the magnet 40 has a circular shape, with a diameter that fits radially within the keys of the grid holder 30.

The position of key ways 26 and 28 and keys 34 and 36 can be better understood by reference to FIG. 4, which is a cross sectional view of the conditioner 10, along the cross section IV—IV of FIG. 3. The keys 34 and 36 preferably do not extend completely through the grid 20 to the front surface 24, so that the keys 34 and 36 do not come in contact with the polishing pad being conditioned. Preferably, the rim 32 extends to the same depth as keys 34 and 36 for the same reason.

The grid holder 30 has a mounting bracket 39 which is used to attach the grid holder 30 to a mechanized arm, which is not shown. The mechanized arm is used to move the grid holder 30 in a rotary motion, and also translates the grid holder 30 across the surface of the polishing pad. The mechanized arm keeps the front surface 24 of the grid 20 in contact with the surface of the polishing pad. The rotational and translational movements conducted from the grid holder 30 to the grid 20 provide to remove debris from the polishing pad, and thus condition the pad.

This conditioning action is enhanced because all of the motion provided by the grid holder 30 is translated to the grid 20, because the key ways of grid 20 and the keys of grid holder 30 will not allow the grid 20 to slip within the grid holder 30. A further benefit of no slippage is that no foreign matter is generated by motion between the grid holder 30 and the attachment means 40, or the attachment means 40 and the grid 20, or if there is no attachment means 40, between the grid holder 30 and the grid 20.

Additionally, because of the relative position or size of the key ways and keys, the grid holder 30 can only receive the grid 20 in a single presentation, thus it is ensured that the abrasive front surface 24 of the grid 20 will make contact with the polishing pad, providing optimum conditioning.

While preferred embodiments of the present invention are described above, it will be appreciated by those of ordinary skill in the art that the invention is capable of numerous modifications, rearrangements and substitutions of parts without departing from the spirit of the invention.

What is claimed is:

1. A conditioner for being rotated relative to, and for being applied to, a polishing pad to condition the polishing pad for chemical mechanical polishing of a semiconductor wafer, comprising:

an abrasive conditioning implement having an abrasive front surface for being rotated in a rotation plane and applied to the polishing pad to condition the polishing pad, the abrasive conditioning implement having a back surface disposed in a spaced apart, oppositely facing, relationship with the abrasive front surface;

an abrasive conditioning implement holder system for receiving and holding the abrasive conditioning implement with the back surface oriented toward the abrasive conditioning implement holder system and exposing the front surface for conditioning the polishing pad, the abrasive conditioning implement holder system for rotating the abrasive conditioning implement in the rotation plane so that the front surface remains in the rotation plane during the rotation;

an interlock system for locking the abrasive conditioning implement to the abrasive conditioning implement holder system to prevent relative rotation between the abrasive conditioning implement and the abrasive conditioning implement holder system while the abrasive conditioning implement is being rotated, and the abrasive conditioning implement holder system and the interlock system having;

a holder for holding the abrasive conditioning implement;

a key formed in the periphery of one of the abrasive conditioning implement and the abrasive conditioning implement holder system;

a key way formed in the periphery of the other of the abrasive conditioning implement and the abrasive conditioning implement holder system and being configured to matingly receive the key when the abrasive conditioning implement is being held by the abrasive conditioning implement holder system; and a magnet disposed between the holder and the abrasive conditioning implement, and having a key way configured to matingly receive the key, for holding the abrasive conditioning implement to the holder.

2. The conditioner of claim 1 wherein the interlock system further comprises:

an asymmetric pattern of keys formed in one of the abrasive conditioning implement and the abrasive conditioning implement holder system; and an asymmetric pattern of key ways formed in the other of the abrasive conditioning implement and the abrasive conditioning implement holder system and being configured to matingly receive the asymmetric pattern of keys when the abrasive conditioning implement is being held by the abrasive conditioning implement holder system, the asymmetric pattern being configured to allow the abrasive conditioning implement to be held in the abrasive conditioning implement holder system with the back surface oriented toward the abrasive conditioning implement holder system and to prevent the abrasive conditioning implement from being received by the abrasive conditioning implement holder system with the front face oriented toward the abrasive conditioning implement holder system.

3. A conditioner for conditioning a polishing pad comprising:

a grid having:

an abrasive surface for conditioning the polishing pad, a back surface opposite the abrasive surface, and, at least one key way extending at least partially into the back surface;

a grid holder having a number of keys equal to the number of key ways in the back surface of the grid, the keys being configured and positioned for engagement into the grid key ways; and attachment means between the grid and the grid holder.

4. The apparatus of claim 3 wherein the key ways of the grid extend completely through the grid, from the back surface of the grid to the abrasive surface of the grid.

5. The apparatus of claim 3 wherein the key ways of the grid and the keys of the grid holder are arranged such that the grid holder can only receive the grid with the back surface of the grid facing the grid holder..

6. The apparatus of claim 3 wherein the grid has a generally circular shape.

7. The apparatus of claim 3 wherein the grid further forms a honeycomb pattern of voids extending completely through the grid, from the back surface of the grid to the abrasive surface of the grid.

8. The apparatus of claim 3 wherein the abrasive surface of the grid further comprises an abrasive element in a binder.

9. The apparatus of claim 8 wherein the abrasive element comprises diamond.

10. The apparatus of claim 8 wherein the binder comprises nickel.

11. A conditioner for conditioning a polishing pad comprising:

a grid having;

an abrasive surface for conditioning the polishing pad, a back surface opposite the abrasive surface, and at least one key way extending at least partially into the back surface;

the grid forming a honeycomb pattern of voids extending completely through the grid, from the back surface of the grid to the abrasive surface of the grid; and a grid holder having a number of keys equal to the number of key ways in the back surface of the grid, the keys being configured and positioned for engagement into the grid key ways.

* * * * *